US007845131B2

(12) United States Patent
Hough

(10) Patent No.: US 7,845,131 B2
(45) Date of Patent: Dec. 7, 2010

(54) CRACK CONTROL FOR CONCRETE

(75) Inventor: Reginald D. Hough, Rhinebeck, NY (US)

(73) Assignee: Engineered Devices Corporation, Ridgefield Park, NJ (US)

( * ) Notice: Subject to any disclaimer, the term of this patent is extended or adjusted under 35 U.S.C. 154(b) by 1107 days.

(21) Appl. No.: 11/535,106

(22) Filed: Sep. 26, 2006

(65) Prior Publication Data

US 2008/0072504 A1 Mar. 27, 2008

(51) Int. Cl.
*E02D 27/00* (2006.01)

(52) U.S. Cl. ..... 52/514.5; 52/127.3; 52/396.02; 52/396.05; 52/309.14; 52/742.14; 52/393; 249/33; 404/47; 404/55

(58) Field of Classification Search ..... 52/159, 52/127.3, 600–601, 396.05, 309.14, 742.14, 52/704, 393, 514.5, 514, 396.02; 525/396.02; 249/33, 83, 91, 210; 404/55, 47
See application file for complete search history.

(56) References Cited

U.S. PATENT DOCUMENTS

| | | | | | |
|---|---|---|---|---|---|
| 1,089,943 | A * | 3/1914 | Morse et al. | ..... | 404/69 |
| 2,167,904 | A * | 8/1939 | Older | ..... | 404/55 |
| 3,411,260 | A * | 11/1968 | Dill | ..... | 52/396.03 |
| 4,090,800 | A * | 5/1978 | Koch | ..... | 404/48 |
| 5,918,428 | A * | 7/1999 | Hough | ..... | 52/127.3 |

* cited by examiner

*Primary Examiner*—Jeanette Chapman
(74) *Attorney, Agent, or Firm*—Notaro, Michalos & Zaccaria P.C.

(57) ABSTRACT

A crack inducer controls propagation of cracks in set concrete containing reinforcing bars. The crack inducer has an elongated, rigid core that is relatively narrow in a direction that is parallel to outer surfaces of the concrete. The core has a core width in a first plane that intersects the outer surfaces of the volume, that is at least 20% of the concrete volume width so that a crack in the volume of concrete is induced to propagate from the core and along the first plane. A plurality of spaced cross-plates are connected to the core and a water-stop may be included around part of the core.

8 Claims, 2 Drawing Sheets

CRACK CONTROL FOR CONCRETE

FIELD AND BACKGROUND OF THE INVENTION

The present invention relates, in general, to devices and methods for inducing controlled cracks in concrete to avoid unsightly cracks on the outer surface of concrete structures.

U.S. Pat. No. 5,918,428, which is incorporated here by reference, was issued to the inventor of the present invention on Jul. 6, 1999. This patent discloses a crack inducer plate assembly for concrete structures that includes an elongated, rigid core plate for extending in concrete at a location spaced from the surface of the structure, and a waterproof, resilient water-stop member fixed to and covering at least part of the core plate. Cross plates are welded to the core plate to anchor the core plate to reinforcing bars in the concrete, and the inventor discovered that cracks were formed in a controlled manner within the concrete volume.

When concrete shrinks during the hydration period, stress in the concrete is relieved by cracking. The cracking is addressed in many ways depending on the conditions or use, for example by providing elongated reveals such as V-shaped or polygonal members of grooved at the surface of the concrete. In most structural concrete, cracking is expected and is not a problem unless the surface is subject to water intrusion, is exposed to view, or both. Then, the issue of cracking becomes important.

A search was conducted at the USPTO in preparation for this disclosure. The search encompassed United States patents categorized under the following U.S. patent classifications: Class 52, Subclasses 127.3, 393, 396.02, 396.05, 601 and 742.14; and Class 404, Sunclasses 47 and 55.

In addition to U.S. Pat. No. 5,918,428 mentioned above, the most pertinent patents found in the search were the following:

| U.S. Pat. No. | Inventor(s) |
|---|---|
| 2,167,904 | Older |
| 2,961,803 | Shapiro et al. |
| 3,411,260 | Dill |
| 3,501,877 | White |
| 3,575,094 | Hewitt et al. |
| 3,596,421 | Miller |
| 3,871,787 | Stegmeier |
| 4,050,206 | Utsuyama |
| 4,090,800 | Koch |
| 4,128,358 | Compton |
| 4,329,080 | Elley |
| 4,362,427 | Mass et al. |
| 4,388,016 | Levey |
| 4,979,846 | Hill et al. |
| 5,375,386 | Goad |
| 5,956,912 | Carter et al. |

U.S. Pat. No. 2,961,803 to Shapiro et al. discloses a combined joint-former and water barrier which is formed of steel, and preferably galvanized steel for corrosion resistance. The joint-former portion includes a strip erected vertically, which has an outer flange bent at a right angle and perforated for nailing to an outer form of the vertical concrete foundation wall. An edge of the joint-former is accommodated within sharply creased V-shaped fold at the mid-portion of a vertical water barrier strip. The V-shaped fold has an apex. The vertical water barrier strip has edge portions with anchoring bent flanges at its extremities adapted for bonding to the concrete and stoppage of water passage. This patent does not disclose a flange connected to a core plate for reducing a tendency for a crack in the volume from propagating from the flange portion nor a water-stop with large beads at the ends of overhanging projections.

U.S. Pat. No. 4,362,427 to Mass et al. discloses a resilient sealing strip for expansion joints in concrete. The strip has three pairs of fins including one pair of fins that form a "T" shape at one end.

U.S. Pat. No. 3,871,787 to Stegmeier discloses a joint structure including a plastic T-shaped channel and a vertical web extending downward from the channel. The vertical web is equipped with anchors disposed at right angles with respect to the vertical plane of the web. The anchors have a horizontal web ending in a vertically oriented flange. The vertical web tapers downwardly to a relatively sharp point or edge that facilitates penetration of the concrete mass by the joint structure.

Other T-shaped control joints are described in U.S. Pat. No. 4,128,358 to Compton and U.S. Pat. No. 4,090,800 to Koch.

Other joint devices were also uncovered. For example, U.S. Pat. No. 2,167,904 to Older discloses a concrete expansion and contraction joint constructed of sheet metal including a parting plate, which is provided to assure the formation of a crack and a dowel plate that projects horizontally from the parting plate into the concrete. Both plates are supported by clamping members which serve as anchoring members. A flange is connected at a right angle to the clamping members. Older '904 does not disclose a resilient water-stop member attached to the clamping member with flange or large beads on a projecting member of a water-stop.

U.S. Pat. No. 5,956,912 to Carter et al. discloses a plastic control joint for controlling concrete structures and cracking. The control joint includes an upstanding web member that extends vertically from a base divided into oppositely extending flanges. Each flange is disposed at a right angle with respect to the upstanding web member. The upstanding web member tapers into an upper edge corner. Arms extend from the web at an intermediate elevation. The flanges have apertures at spaced apart locations to accept ground stakes.

U.S. Pat. No. 3,575,094 to Hewitt discloses a hollow plastic expansion joint and water lock having a U-shaped portion connected to the sidewalls of a V-shaped end with an apex. Lateral flanges having grooved beads project from the sidewalls for anchoring the flanges in concrete.

U.S. Pat. No. 4,979,846 to Hill et al. discloses a contraction joint comprising a base, a central projection extending upwardly from the base with an upper apex section, and a plurality of water stops attached to the base. The water-stops extend upwardly from the base and are characterized by round-shaped tops.

U.S. Pat. No. 3,501,877 to White discloses a joint spacer having a V-shaped body having diverging legs with holes for allowing mortar to flow through the holes to form a bond through and around the spacer.

The remaining patents are cited for general reference.

Although the concept of controlling cracking in concrete floors, that is, generally horizontally extending concrete strictures, has been accepted, the control of cracking in generally vertically concrete structures such as walls, piers, columns and beams, has not.

An article by the present inventor, "Cracking in Architectural Concrete," Reginald D. Hough, Concrete Industry Board Bulletin, 1999, discusses some of his original thinking on the subject.

The present disclosure seeks to improve on that thinking and to provide a new invention that reflects his further understanding and discovery in this field.

SUMMARY OF THE INVENTION

Accordingly it is an object of the present invention to provide a crack inducer arrangement for controlling propagation of cracks in a volume of set concrete having opposite outer surfaces and a plurality of reinforcing bars arranged within the volume and between the outer surfaces of the volume, the volume having a volume width between the outer surfaces, the arrangement including an elongated, preferably metal, galvanized metal, resin coated metal or stainless steel sheet metal, rigid core that is relatively narrow in a direction that is parallel to the outer surfaces and perpendicular to the elongation direction of the core, the core being adapted to extend in the volume at a location spaced inwardly of the opposite outer surfaces of the volume, the core having a core width in a first plane that intersects the outer surfaces of the volume, the core width being at least 20% but preferably at least 33.3% of the volume width, so that a crack in the volume of concrete is induced to propagate from the core and along the first plane. The arrangement also includes a plurality of spaced cross-plates connected to at least parts of the core and adapted to be located within the volume of concrete.

Another object of the invention is to provide a crack inducer arrangement for controlling propagation of cracks, comprising an elongated, rigid core member adapted to extend in the volume, the core member having a plate portion lying in a first plane that is adapted to intersect at least one of the outer surfaces of the volume, a crack in the volume of concrete being induced to propagate from the plate portion and in the first plane, and a relatively resilient water-stop member extending at least partly around the plate portion on a side of the plate portion that faces one of the outer surfaces, the water-stop member including a solid portion extending beyond the plate portion and having a tapered edge spaced from the plate portion, the water-stop member including a pair of side portions connected to the solid portion and extending at opposite sides of the plate portion, and at least one projection extending at least party over the flange portion of the core member, the projection contributing to a clotting of calcium effervescence from the concrete volume near the water-stop member to avoid calcium effervescence from reaching a crack induced by the plate portion, the projection including a wing portion having an outer edge and an enlargement along the outer edge of the wing portion for trapping the clotting calcium effervescence adjacent the plate portion and away from the outer surfaces of the concrete.

A still further object of the invention is to provide such a crack inducer that includes at least one flange portion connected to the plate portion and lying in a second plane that is at a non-zero angle to the first plane with at least one perforation in the flange portion for accepting concrete from the volume of concrete and for reducing a tendency of a crack in the volume from propagating from the flange portion, the water-stop member extending at least partly around the plate portion on a side of the plate portion that is opposite the flange portion, the non-zero angle being about 120 to 60 degrees (preferably 90 degrees), and the plate and flange portions forming an L-shape or a T-shape.

According to another object of the invention the crack inducer comprises a core made of an elongated, rigid and hollow triangular or other polygonal core member of sheet metal adapted to extend in the volume at a location spaced inwardly of the opposite outer surfaces of the volume, the core member having outer flanges and the spaced cross-plates being connected to the core outer flanges. The sheet metal is preferably stainless steel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention have been illustrated.

DESCRIPTION OF THE PREFERRED EMBODIMENTS

Figure 1:
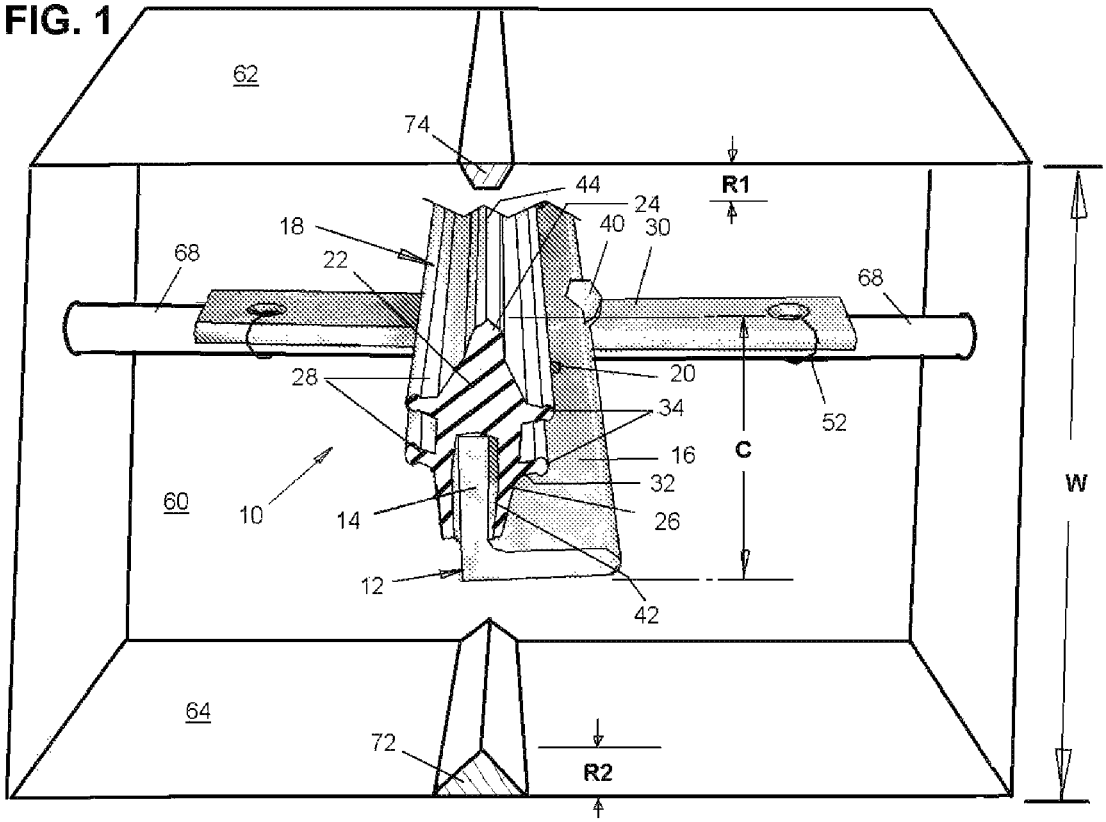
FIG. 1 is a top perspective view of a vertical wall or column, including the crack inducer of the present invention, with the concrete depicted as being transparent to disclose details of the invention.
Figure 2:
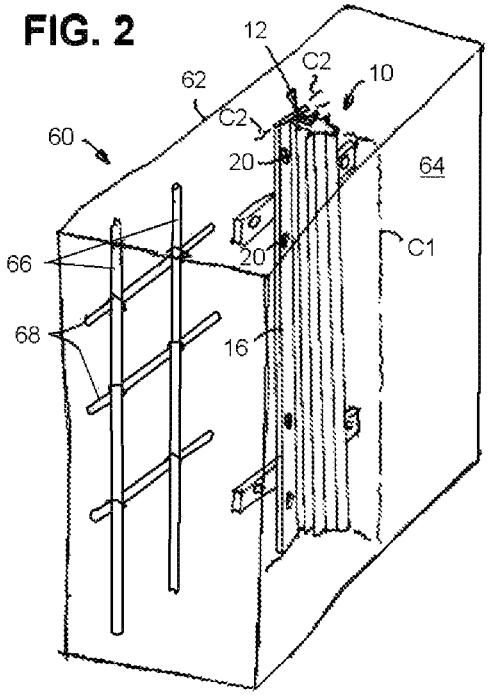
FIG. 2 is a side perspective view of an embodiment of the invention that is similar to that of FIG. 1.

Referring now to the drawings, in which like reference numerals are used to refer to the same or functionally similar elements, FIGS. 1 and 2 illustrate the crack inducer arrangement 10 of the present invention for controlling the propagation of cracks in a volume of concrete or a concrete structure 60 having outer vertical surfaces 62 and 64 defining a volume width W of the structure. The volume 60, which may be a section of wall, pier, column or even a concrete beam, contains reinforcing bars or re-bars 66 and 68 of known placement and design. Only a small section of concrete volume 60 is shown in FIG. 1, with the structure extending vertically, that is, into and out of the plane of FIG. 1, and to the left and right of the figure.

The crack inducer 10 includes an elongated and relatively rigid core plate 12 of steel, plastic or other material of sufficient rigidity, a water-stop 18 of elasomer material, and a plurality of spaced cross-plates 30 of steel, connected to the core plate 12, e.g. by welding or other rigid fastening method.

Figure 5:
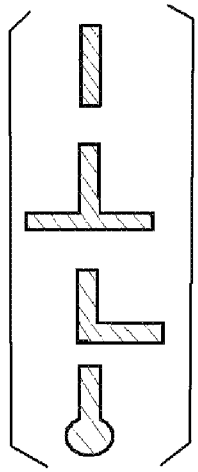
FIG. 5 is a view of some cross-sectional shapes for the core plate of the embodiment of FIGS. 1 to 3.

The core plate 12, which is preferably galvanized, resin or epoxy coated or otherwise corrosion resistant, includes a plate portion 14 of rectangular cross-section, for example, and may also include an enlarged portion 16, such as a flange portion having a width in a direction parallel to the outer surfaces 62 and 64 and perpendicular to the elongation direction of the core plate, that is relatively narrow. The plate portion 14 with the flange portion 16, together may form an L-shape or a T-shape (see FIG. 2) or portion 16 may be a circular or other shaped enlargement so that the plate and flange portions for a bulbous shape (see FIG. 5). The angle between plate and flange portions 14 and 16 may alternatively be other than a right angle, but may be an acute or an obtuse angle. The flange 16 has holes or perforations 20 through which the concrete migrates, minimizing the propagation of cracks traverse to the plate core 12 (C2 in FIG. 2).

The water-stop 18 is a resilient member made, for example, of a GEON (a registered trademark) R1700D brand polymer blend available from Polyone Corporation of Avon Lake Ohio. Polyvinyl chloride or similar semi-flexible polymer or rubber material that resists water can be used for the water-stop, or various other materials can be used to form the water-stop 18 of the crack inducer. The water-stop is preferably an extrusion, and can be made alternatively of polyethylene, urethane, thermoplastic elastomers (TPE) or other suitable materials. Water-stop 18 extends at least partly around the plate portion 14 and includes a solid portion 22, a tapered edge portion 24 ending at a corner 44 facing away from the core plate 12, a pair of side portions 26 connected to the solid portion 22, and projections 28 overhanging the flange portion 16, or both flanges when the T-shaped core member of FIG. 2 is used.

Although a wide variety of polymer blends or other relatively resilient materials is usable as the water stop, the example that has been reduced to practice is a blend of Di(2-ethylhexyl)phthalate with calcium carbonate, carbon black, lead stearate and lead oxide sulfate.

The projections 28 slow down the migration of calcium effervescence and therefore contribute to a clotting of calcium effervescence from the concrete volume near the water-stop member to avoid calcium effervescence from reaching the crack induced by the core plate 12. The projections include a wing portion 32 and a large circular-cross-sectioned bead 34 or other shaped enlargement at the tip end for localizing the calcium effervescence further and therefore keeping it away from the induced cracks, shown for example at C1 and C2 in FIG. 2.

The water-stop 18 is fixed to the core plate 12 by a waterproof material such as epoxy adhesive, wire through aligned holes in the water-stop and plate portion, or both.

As shown in FIG. 1, the crack inducing core of the invention includes either the plate combination 14, 16 with water-stop 18 alone that together have a core width C in the direction of the plane of plate portion 14, or include one or two reveals 72 and 74 that are imbedded at the outer surfaces 62 and 64 and extend parallel to the plates and in the concrete volume by widths R1 and R2.

The inventor has discovered that, unexpectedly, if the core width; that is the total of C plus R1 plus R2 (understanding that R1 and/or R2 may be zero if no reveal is used); if this total core width is at least 20% of the volume width W, and preferable at least ⅓ of the total volume width W, then favorable crack induction and control occurs.

This is contrary the convention thinking in the art which either believes that such incorporated cores only have adverse effects or have no effect at all on controlling cracks in vertically extending concrete structures.

Figure 3:
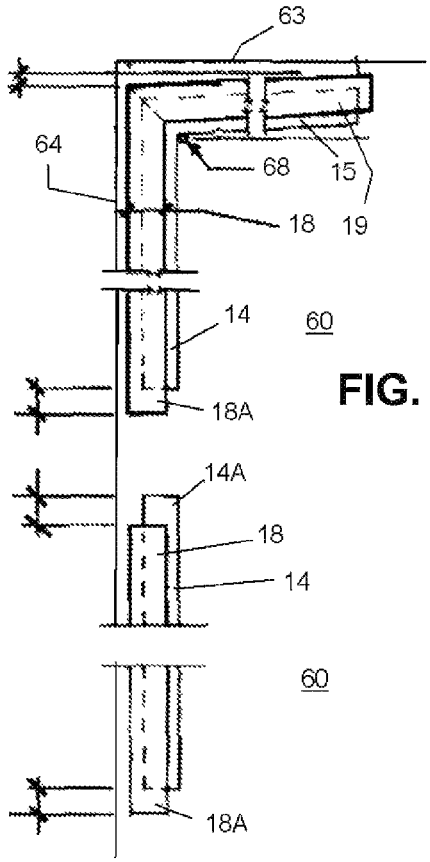
FIG. 3 is a side elevational view of a modified embodiment of the invention for use at the top of a concrete wall, pier, column or beam.

As shown in FIG. 3, the volume of concrete 60 may include an end surface 63, in this case the top of the a concrete wall, pier or beam. End surface 63 extends transversely, e.g. 90 degrees or some other angle, i.e. about 40 to 140 degrees, to at least one of the outer surfaces 64. The elongated, rigid core 12 of the invention will now include the plate portion 14 plus an angle plate 15 lying in the first plane and extending adjacent the end surface and inside the volume, at a non-zero angle to the plate portion 14, for inducing a crack toward the end surface 63 from the angle plate 15. Angle plate 15 also includes a water-stop 19 of the same construction as water-stop 18, and extending partly around plate 15. Angle plate 15 preferably extends at an angle of about 4 degrees to the plate portion 14 and to the end surface, or about 60 to 120 degrees from plate portion 14 and/or to end surface 63, depending on the angle of end surface 63.

The main purpose of the angle plate 15 with its water-stop 19 is to direct the induced crack from the vertical plate 14 and water-stop 18 below, to continue straight across the top of the wall, pier or beam 60, and to provide a water-stop across the top of the concrete structure at the crack. The angle 15 should also extend substantially the entire width of the structure.

As also shown in FIG. 3, the crack inducer of the present invention can be made in modular lengths of about 3 to 8 feet and the ends of each length include either a plate portion extension 14A or a water-stop extension 18A, so that the ends can be spliced and bonded together by epoxy or structural sealant with the plate portion extension 14A of one length extending into the water-stop extension 18A of the next length.

Figure 4:
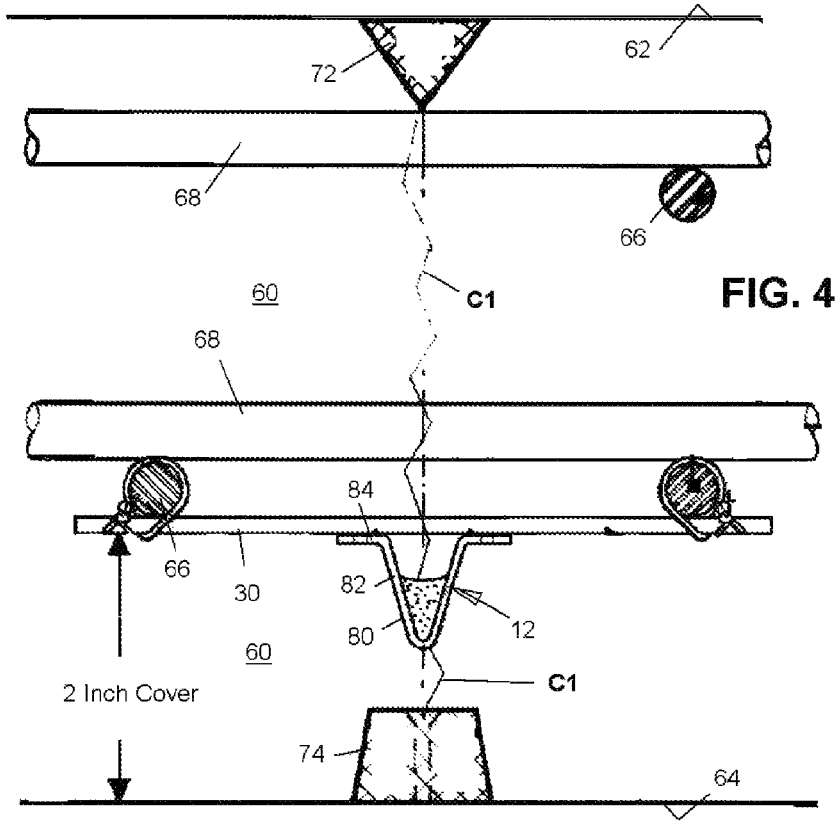
FIG. 4 is a top plan view of a concrete volume containing another embodiment of the invention.

Referring now to FIG. 4, the crack inducer core 12 of the present invention is a hollow polygonal body 80 that is preferably a sheet of stainless steel that is elongated and bent to shape, e.g. with hollow body sides or walls 82 forming the two sides of a triangle in sectional view as shown in FIG. 4, and a pair of flanges 84 that are connected, e.g. by welding to the cross plates 30 at are, in turn, connected, e.g. by wires, to the re-bars 66 or 68. The height of the triangle with the sides 82 can be about 1.5 inches, for example, with flanges that are each about 0.5 inches wide. This height can increase to about 2.75 inches when no reveal is used. An approximately 12 to 24 inch long cross plate 30 of steel is advantageous, that is ⅛" thick and ¼" wide or otherwise vary in size and/or shape. The cross plates 30 are placed to form a 1 to 3 inch cover (e.g. 2 inches) from the concrete surface 64, for example. All dimensions are given as examples only, however.

No external elastomeric water-stop is needed in the embodiment of FIG. 4, however, since the V-shaped configuration forms a natural water-stop and crack inducer in one. The hollow interior of the polygon 82 can be partly filled with porous air containing material for creating a void in the core member. This material may be simple expandable foam insulation material that is sprayed into the hollow space inside sides 82 to about half fill it, before the core 12 is installed or at least before the concrete is poured. It does not matter that the foam eventually deteriorates since once the concrete is poured and the void is formed, the void in the concrete will remain for the life of the wall, pier, column or beam, i.e. decades or longer. This void now forms the cite for calcium effervescence so that this white chalky deposit stays near the core member and away from the crack C1 that is controlled by the present invention.

Although a triangular core body 80 is shown the hollow polygon can have a greater number of sides, for example, it may be a trapezoid, a rhombus, a square, a rectangle or any other four sides hollow figure that is preferably open toward the cross plates, or a five, six, seven or higher sided hollow, open figure. Stainless steel is used because of its corrosion resistance. The least expensive grade stainless steel is preferred with gauges from 24 to 18 being advantageous, depending on the size of the concrete structure and the demands that will be put on this wall, pier, column or beam.

While specific embodiments of the invention have been shown and described in detail to illustrate the application of the principles of the invention, it will be understood that the invention may be embodied otherwise without departing from such principles.

What is claimed is:

1. A crack inducer arrangement for controlling propagation of cracks in a volume of set concrete having opposite outer vertical surfaces and a plurality of reinforcing bars arranged within the volume and between the outer surfaces of the volume, the arrangement comprising:

an elongated, rigid and vertical core member adapted to extend in the volume at a location spaced inwardly of the opposite outer surfaces of the volume, the core member having a plate portion lying in a first plane that is adapted to intersect at least one of the outer surfaces of the volume, a crack in the volume of concrete being induced to propagate from the plate portion and in the first plane, the vertical core member including at least one flange portion connected to the plate portion and lying in a second plane that is at a non-zero angle to the first plane and that is substantially parallel to one of the outer surfaces of the volume of concrete that is closest to the flange; and a relatively resilient water-stop member extending at least partly around the plate portion on a side of the plate portion that faced one of the outer surfaces, the water-stop member including a solid portion extending beyond the plate portion and having a tapered edge spaced from the plate portion, the water-stop member including a pair of side portions connected to the solid portion and extending at opposite sides of the plate portion, and at least one projection extending at least party over the flange portion of the core member, the projection contributing to a clotting of calcium effervescence from the concrete volume near the water-stop member to avoid calcium effervescence from reaching a crack induced by the plate portion, the projection including awing portion having an outer edge and an enlargement along the outer edge of the wing portion for trapping the clotting calcium effervescence adjacent the plate portion and away from the outer surfaces of the concrete;

the at least one flange portion having at least one perforation in the flange portion for accepting concrete from the volume of concrete and for reducing a tendency of a crack in the volume from propagating from the flange portion, the water-stop member extending at least partly around the plate portion on a side of the plate portion that is opposite the flange portion, the non-zero angle being about 120 to 60 degrees, and the plate and flange portions forming one of an L-shape, a T-shape and a bulbous shape.

2. An arrangement according to claim 1, including a plurality of spaced cross-plates connected to the core member and adapted to be located within the volume of concrete, for anchoring the arrangement in the volume of concrete.

3. An arrangement according to claim 1, including a water-proof adhesive adhering the water-stop member to the plate portion.

4. An arrangement according to claim 1, including a plurality of said projections on each side of the water-stop member.

5. An arrangement according to claim 1, wherein the tapered edge portion ends at an corner.

6. An arrangement according to claim 1, wherein the rigid core member is one of galvanized steel, stainless steel, plastic, and steel coated with water-proof resin.

7. An arrangement according to claim 1, wherein the volume of concrete includes an end surface extending transversely to at least one of the outer surfaces, the core member including an angle plate lying in the first plane and extending adjacent the end surface and inside the volume, at a non-zero angle to the core for inducing a crack toward the end surface from the angle plate.

8. An arrangement according to claim 1, wherein the core and water-stop members are in modular lengths having ends include a plate portion extension at one end and a water-stop extension at an opposite end, so that the ends can be spliced together by the plate portion extension of one length extending into the water-stop extension of a next length.

* * * * *